US009410540B2

(12) United States Patent
Mizoguchi et al.

(10) Patent No.: US 9,410,540 B2
(45) Date of Patent: Aug. 9, 2016

(54) VARIABLE DISPLACEMENT HYDRAULIC MOTOR/PUMP

(75) Inventors: Norihide Mizoguchi, Kuki (JP); Mitsuru Ohshiro, Tokyo (JP); Takahiro Adachi, Oyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/696,984

(22) PCT Filed: Nov. 17, 2011

(86) PCT No.: PCT/JP2011/076556

§ 371 (c)(1),
(2), (4) Date: Nov. 8, 2012

(87) PCT Pub. No.: WO2012/114589

PCT Pub. Date: Aug. 30, 2012

(65) Prior Publication Data

US 2014/0186196 A1 Jul. 3, 2014

(30) Foreign Application Priority Data

Feb. 23, 2011 (JP) ..... 2011-037707

(51) Int. Cl.
*F04B 1/20* (2006.01)
*F04B 1/32* (2006.01)
(Continued)

(52) U.S. Cl.
CPC ..... *F04B 1/2085* (2013.01); *F03C 1/0671* (2013.01); *F04B 1/324* (2013.01); *F04B 53/18* (2013.01); *F03C 1/0644* (2013.01); *F04B 1/122* (2013.01); *F04B 1/22* (2013.01)

(58) Field of Classification Search
CPC ..... F04B 1/20; F04B 1/324; F04B 39/0284; F04B 39/0292; F04B 1/22; F04B 1/2085; F04B 27/0804; F04B 53/18; F03C 1/0644; F03C 1/0671
USPC ..... 417/269, 272; 92/13, 71, 157, 158, 154; 91/483, 505; 184/6.17, 6.5
See application file for complete search history.

(56) References Cited

U.S. PATENT DOCUMENTS 2,240,118 A * 4/1941 Matthews ..... F16C 19/386 184/11.1
3,154,353 A * 10/1964 Haringx et al. ..... 384/101
(Continued)

FOREIGN PATENT DOCUMENTS

AU 23717/70 A 6/1972
CN 101925739 A 12/2010
(Continued)

OTHER PUBLICATIONS

International Search Report dated Dec. 13, 2011, issued for PCT/JP2011/076556.
(Continued)

*Primary Examiner* — Devon Kramer
*Assistant Examiner* — Joseph Herrmann
(74) *Attorney, Agent, or Firm* — Locke Lord LLP

(57) ABSTRACT

In a variable displacement hydraulic pump/motor, a casing includes a tapered roller bearing supporting a rotating shaft near supports, the support has a sliding protruding portion in a spherical shape at a shaft portion, and a through oil path extending from the shaft portion to the sliding protruding portion, the support being fitted, at the shaft portion, in a mounting hole in the casing and being fitted, at the sliding protruding portion, in a sliding recessed portion in the swash plate to cover an opening of the through oil path, a communicating oil path is between a space in which a tapered roller of the tapered roller bearing is disposed and the mounting hole, and a lubrication groove constantly connecting the opening of the through oil path to an outside of a sliding contact area between the sliding protruding portion and the sliding recessed portion.

5 Claims, 5 Drawing Sheets

(51) Int. Cl.

| | |
|---|---|
| ***F04B 53/18*** | (2006.01) |
| *F03C 1/06* | (2006.01) |
| *F04B 1/12* | (2006.01) |
| *F04B 1/22* | (2006.01) |

(56) References Cited

U.S. PATENT DOCUMENTS

| | | | | | |
|---|---|---|---|---|---|
| 3,183,849 | A | * | 5/1965 | Raymond | 417/270 |
| 3,639,018 | A | * | 2/1972 | Wilkes | 384/553 |
| 3,703,178 | A | * | 11/1972 | Schreiber et al. | 184/6.5 |
| 3,981,630 | A | * | 9/1976 | Leduc et al. | 417/269 |
| 4,934,253 | A | | 6/1990 | Berthold et al. | |
| 5,095,807 | A | * | 3/1992 | Wagenseil | 92/12.2 |
| 5,172,623 | A | * | 12/1992 | Poisson | F04B 1/2028 184/6.17 |
| 5,399,026 | A | * | 3/1995 | Witte | 384/463 |
| 5,590,579 | A | | 1/1997 | Weber | |
| 5,826,488 | A | * | 10/1998 | Arai et al. | 92/12.2 |
| 6,077,050 | A | * | 6/2000 | Beck | 417/269 |
| 6,095,766 | A | * | 8/2000 | Brown | 417/398 |
| 6,406,271 | B1 | * | 6/2002 | Valentin | 417/269 |
| 6,880,450 | B2 | * | 4/2005 | Stolzer | 92/12.2 |
| 6,921,205 | B2 | * | 7/2005 | Kanayama et al. | 384/13 |
| 2008/0124017 | A1 | | 5/2008 | Umekida | |
| 2010/0287926 | A1 | | 11/2010 | Ogasawara et al. | |
| 2011/0271828 | A1 | | 11/2011 | Roth | |

FOREIGN PATENT DOCUMENTS

| | | | | |
|---|---|---|---|---|
| DE | 1288432 | B | | 1/1969 |
| DE | 2106067 | A1 | | 9/1971 |
| DE | 2118018 | A1 | | 11/1971 |
| DE | 2527189 | A1 | | 1/1976 |
| DE | 3743125 | A1 | | 7/1989 |
| DE | 3942189 | C1 | | 9/1991 |
| DE | 69609582 | T2 | | 4/2001 |
| DE | 102006055161 | A1 | | 5/2008 |
| DE | 102007062008 | A1 | | 6/2009 |
| DE | 102008048495 | A1 | | 3/2010 |
| DE | 102009005390 | A1 | | 7/2010 |
| JP | 2002-013611 | A | | 1/2002 |
| JP | 2003-139045 | A | | 5/2003 |
| JP | 2006-207445 | A | | 8/2006 |
| JP | 2008-101581 | A | | 5/2008 |
| JP | 2008101581 | A | * | 5/2008 |
| JP | 2008-232118 | A | | 10/2008 |
| JP | 2008232118 | A | * | 10/2008 |

OTHER PUBLICATIONS

Office Action dated Feb. 3, 2015 issued for corresponding German Patent Application No. 112011101456.2.

* cited by examiner

VARIABLE DISPLACEMENT HYDRAULIC MOTOR/PUMP

FIELD

The present invention relates to a variable displacement hydraulic pump/motor in which a displacement is changed by changing a tilt angle of a swash plate and specifically to a lubricating structure of supports for supporting the swash plate in a casing so that the swash plate can tilt.

BACKGROUND

In a variable displacement hydraulic pump/motor in which a displacement is changed by changing a tilt angle of a swash plate, a swash plate is supported in a casing by a pair of supports so as to be able to tilt, in general. Each of the supports is a circular columnar shaft portion having a tip end provided with a spherical sliding protruding portion. The two supports are mounted at the shaft portions thereof into mounting holes so that a line connecting centers of the spheres of the sliding protruding portions extends along a direction perpendicular to an axial center of a rotating shaft supporting a cylinder block. On the other hand, sliding recessed portions in which the sliding protruding portions are to be fitted are formed in the swash plate and the sliding protruding portions of the supports are respectively fitted for sliding in the respective sliding recessed portions.

In the hydraulic pump/motor, if the tilt angle of the swash plate is changed with respect to the axial center of the rotating shaft, stroke movement amounts of pistons disposed in cylinders in the cylinder block change according to the tilt angle of the swash plate and the displacement of the hydraulic pump/motor changes.

In this type of hydraulic pump/motor, oil is supplied between the sliding protruding portions of the supports and the sliding recessed portions in the swash plate from a port on a high-pressure side, i.e., a port for discharging the oil in a case of the hydraulic pump and a port to which the oil is supplied in a case of the hydraulic motor to carry out lubrication to thereby prevent problems such as seizing and galling from occurring (see Patent Literature 1, for example).

CITATION LIST

Patent Literature

Patent Literature 1: Japanese Patent Application Laid-open No. 2003-139045

SUMMARY

Technical Problem

The two supports for supporting the swash plate and on the high-pressure side and the low-pressure side receive different reaction forces from the pistons and therefore contact pressures between their sliding protruding portions and the sliding recessed portions are different as well. Here, there is no problem if the oil is supplied from the port on the high-pressure side to the support for supporting a high-pressure side of the swash plate. However, if the oil is supplied between the sliding protruding portion of the support, for supporting a low-pressure side of the swash plate, and the sliding recessed portion from the port on the high-pressure side, a force acting on the swash plate due to pressure of the oil becomes greater than a force received from the piston and the swash plate may move with respect to the casing in such a direction as to approach the cylinder block.

With the above-described circumstances in view, it is an object of the present invention to provide a variable displacement hydraulic pump/motor in which reliable lubrication can be carried out between sliding protruding portions of supports and sliding recessed portions in a swash plate without causing a problem such as movement of the swash plate with respect to a casing.

Solution to Problem

To overcome achieve the object, according to the present invention, a variable displacement hydraulic pump/motor comprises: a rotating shaft rotatably supported in a casing; a cylinder block rotating with the rotating shaft, the cylinder block including a plurality of cylinders on a circumference, a center of which is at an axial center of the rotating shaft; a plurality of pistons respectively disposed to be movable in the cylinders in the cylinder block; and a swash plate disposed to be able to tilt in the casing with a pair of supports interposed between the swash plate and the casing at a position facing openings of the cylinders provided in the cylinder block, the swash plate slidably engaged, at a sliding face of the swash plate facing the cylinder block, with base end portions of the respective pistons, the pistons moving in strokes according to a tilt angle of the swash plate when the cylinder block rotates with respect to the swash plate, wherein the casing includes a bearing rotatably supporting the rotating shaft near the supports, each of the supports has a sliding protruding portion formed in a spherical shape at a tip end of a shaft portion of the each of the supports, and a through oil path formed to extend from an outer surface of the shaft portion to an outer peripheral face of the sliding protruding portion, each of the supports being fitted, at the shaft portion of the each of the supports, in a mounting hole in the casing and being fitted slidably, at the sliding protruding portion of the each of the supports, in a sliding recessed portion in the swash plate so as to cover an opening of the through oil path, a communicating oil path is formed between a housing space for housing the bearing in the casing and the mounting hole and communicates with the through oil path in the shaft portion, and a lubrication groove constantly connecting the opening of the through oil path in the sliding protruding portion to an outside of a sliding contact area between the sliding protruding portion and the sliding recessed portion is formed between the sliding protruding portion of the support and the sliding recessed portion in the swash plate.

According to the present invention, each of the lubrication grooves is formed in the sliding protruding portion in such a manner as to draw a spiral about the shaft portion of the support.

According to the present invention, the bearing interposed between the casing and the rotating shaft is a tapered roller bearing including a tapered roller having a diameter which is larger at an end portion close to the swash plate.

According to the present invention, each of the supports has the sliding protruding portion at a tip end of the shaft portion formed in a circular columnar shape and the through oil path is formed on an axial center of the shaft portion.

Advantageous Effects of Invention

According to the invention, the housing space for housing the bearing and a space for housing the swash plate communicate each other through the communicating oil paths, the mounting holes, the through oil paths, and the lubrication grooves, and therefore, if the bearing rotates as a result of rotation of the rotating shaft, oil stored in the housing space flows due to a centrifugal force and passes through the lubrication grooves formed between the sliding protruding portions of the supports and the sliding recessed portions in the swash plate. Therefore, with the oil filling the lubrication grooves, it is possible to carry out lubrication between the sliding protruding portions and the sliding recessed portions. Furthermore, pressure of the oil passing through the lubrication grooves due to a centrifugal force is sufficiently lower than pressure of oil on a high-pressure side and therefore a problem such as movement of the swash plate toward the casing is not caused.

DESCRIPTION OF EMBODIMENT

A preferred embodiment of a variable displacement hydraulic pump/motor according to the present invention will be described below in detail with reference to the accompanying drawings.

Figure 1:
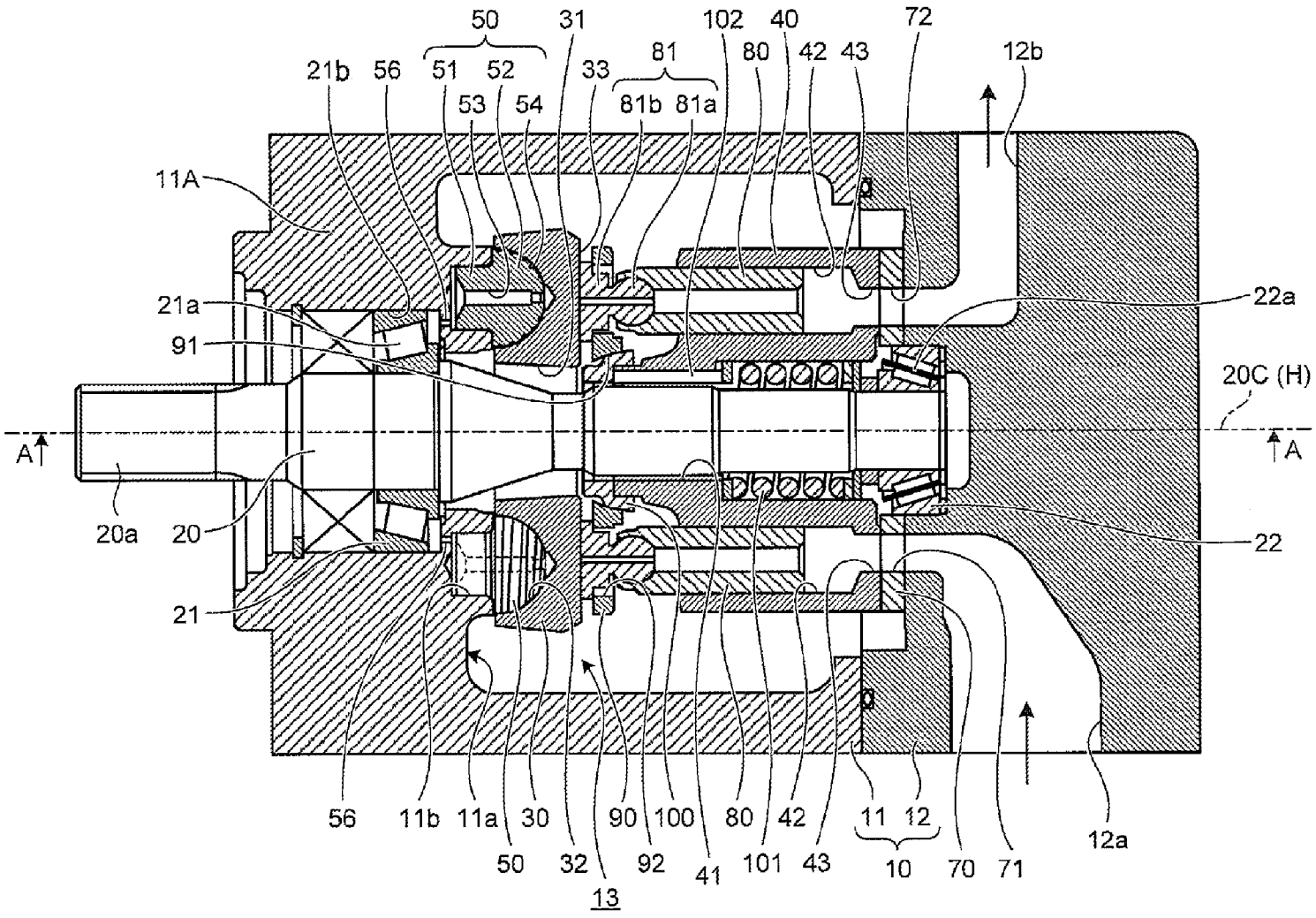
FIG. 1 is a sectional view taken along a plane passing through axial centers of a pair of supports in a variable displacement hydraulic pump/motor which is an embodiment of the present invention.
Figure 2:
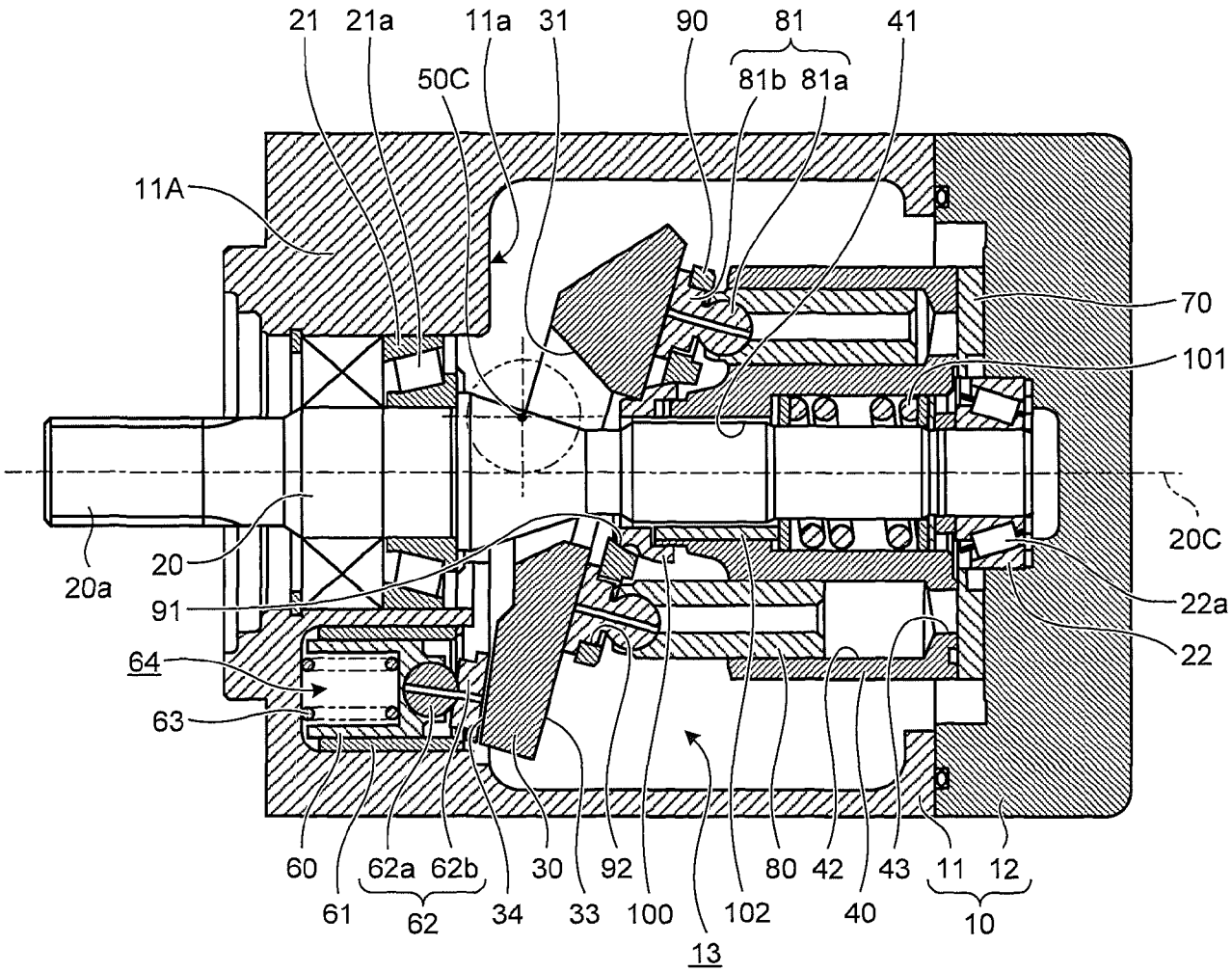
FIG. 2 is a sectional view along line A-A in FIG. 1.

FIGS. 1 and 2 illustrate the variable displacement hydraulic pump/motor which is the embodiment of the invention. The hydraulic pump/motor illustrated here as an example operates as a hydraulic pump when power is applied from outside and includes a rotating shaft 20 inside a casing 10.

The casing 10 includes a case main body portion 11 and an end cap portion 12 and an operation space 13 is formed between the case main body portion 11 and the end cap portion 12. The rotating shaft 20 is a columnar member disposed to extend across the operation space 13 in the casing 10. The rotating shaft 20 has one end portion rotatably supported in a base end wall 11A of the case main body portion 11 with a main body-side bearing 21 interposed therebetween and the other end portion rotatably supported in the end cap portion 12 with a cap-side bearing 22 interposed therebetween and the rotating shaft 20 can rotate about its rotation axial center 20C with respect to the casing 10. Both of the main body-side bearing 21 for supporting the one end portion of the rotating shaft 20 in the base end wall 11A of the case main body portion 11 and the cap-side bearing 22 for supporting the other end portion in the end cap portion 12 are what are called tapered roller bearings having tapered rollers and are disposed in such orientations that large-diameter end portions of tapered rollers 21*a* and 22*a* are close to a swash plate 30 which will be described later. The one end portion of the rotating shaft 20 functions as an input end portion 20*a* for receiving the power from an external power source such as an engine and protrudes outside from the base end wall 11A of the case main body portion 11. The other end portion of the rotating shaft 20 ends in the end cap portion 12. The rotating shaft 20 is provided, at a position on its outer periphery corresponding to the operation space 13, with the swash plate 30 and a cylinder block 40.

The swash plate 30 is a plate-shaped member having a shaft insertion hole 31 in a central portion. The swash plate 30 is supported on the base end wall 11A of the case main body portion 11 with a pair of ball retainers (supports) 50 interposed therebetween and with the rotating shaft 20 inserted through the shaft insertion hole 31. In the case main body portion 11, the base end wall 11A provided with the pair of ball retainers 50 is provided in a position close to the main body-side bearing 21 which supports the rotating shaft 20.

Each of the ball retainers 50 is formed by integrally molding a circular columnar shaft portion 51 and a sliding protruding portion 52 formed in a hemispherical shape having a larger diameter than the shaft portion 51. Each of the ball retainers 50 is mounted to the casing 10 by fitting the shaft portion 51 into a mounting hole 11*b* formed in the base end wall 11A of the case main body portion 11 and the sliding protruding portion 52 is fitted for sliding in a sliding recessed portion 32 formed in the swash plate 30. The swash plate 30 supported by these ball retainers 50 can tilt with respect to the casing 10 about a straight line connecting center points of the sliding protruding portions 52 as a tilt center line 50C (see FIG. 2). In the present embodiment, the tilt center line 50C of the swash plate 30 by the ball retainers 50 is set in a plane orthogonal to the rotation axial center 20C of the rotating shaft 20 and in a position displaced upward from the rotation axial center 20C in FIG. 2. The rotation axial center 20C of the rotating shaft 20 is at equal distances from the center points of the respective sliding protruding portions 52 and is in a vertical plane (hereafter referred to as "division plane H") which bisects the tilt center line 50C as illustrated in FIG. 1.

The swash plate 30 is substantially bilaterally symmetric (not illustrated in the drawings) with respect to the division plane H and has a first sliding face 33 on a side facing the end cap portion 12 and a second sliding face 34 on a side facing an inner surface 11*a* of the base end wall 11A of the case main body portion 11 as illustrated in FIGS. 1 and 2. The first sliding face 33 is formed as an annular flat face, on which a piston shoe 81 (described later) slides, at a portion around the shaft insertion hole 31. The second sliding face 34 is a flat face formed only at a lower peripheral edge in FIG. 2 and is inclined so that a plate thickness increases toward the tilt center line 50C.

A servo piston 60 is provided between the second sliding face 34 of the swash plate 30 and the base end wall 11A of the case main body portion 11. The servo piston 60 is movably disposed in a servo sleeve 61 fixed to the case main body portion 11 and is in contact with the second sliding face 34 of the swash plate 30 with a servo piston shoe 62 interposed therebetween. The servo piston shoe 62 is supported, at its servo spherical portion 62*a* formed in a shape of a sphere, on a tip end portion of the servo piston 60 so as to be able to tilt and is in contact, at its columnar servo pedestal portion 62*b*, with the second sliding face 34 so as to be able to slide. The servo piston 60 is constantly in contact with the second sliding face 34 of the swash plate 30 due to a pressing force of a servo piston spring 63 provided between the case main body portion 11 and the servo piston 60 and tilts the swash plate 30 about the tilt center line 50C to thereby change a tilt angle of the swash plate 30 with respect to the rotating shaft 20 when hydraulic pressure of a servo hydraulic pressure chamber 64 is changed.

The cylinder block 40 is a circular columnar member having a central hole 41 and disposed between the end cap portion 12 and the swash plate 30 with the rotating shaft 20 inserted through the central hole 41. The central hole 41 of the cylinder block 40 and an outer peripheral face of the rotating shaft 20 are coupled by splines so that the cylinder block 40 rotates with the rotating shaft 20. An end portion of the cylinder block 40 facing the end cap portion 12 is in contact with an inner wall face of the end cap portion 12 with a valve plate 70 interposed therebetween. On the other hand, an end portion of the cylinder block 40 facing the swash plate 30 is exposed into the operation space 13.

As illustrated in FIG. 1, the valve plate 70 is a plate-shaped member having an intake port 71 and a discharge port 72. The intake port 71 is connected to an intake passage 12*a* formed in the end cap portion 12 and is connected to an oil tank (not illustrated) through the intake passage 12*a*. The discharge port 72 is connected to a discharge passage 12*b* formed in the end cap portion 12 and is connected to an object of supply of oil, e.g., a hydraulic operating machine (not illustrated) through the discharge passage 12*b*. Though it is not clearly illustrated in the drawings, the intake port 71 and the discharge port 72 in the valve plate 70 are in shapes of arcs formed on the same circumference the center of which is at the rotation axial center 20C of the rotating shaft 20 and the discharge port 72 and the intake port 71 are formed independently of each other while separated by the division plane H.

In the cylinder block 40, a plurality of cylinders 42 are formed on the circumference the center of which is at the rotation axial center 20C of the rotating shaft 20. The cylinders 42 are holes formed parallel to the rotation axial center 20C of the rotating shaft 20 and having circular cross sections and are disposed at equal intervals along a circumferential direction. Each of the cylinders 42 is open in an end face of the cylinder block 40 facing the swash plate 30 and has an end portion which is close to the valve plate 70, ends in the cylinder block 40, and then is open in an end face of the cylinder block 40 through a small-diameter communicating port 43. An opening of the communicating port 43 is positioned on the same circumference on which the intake port 71 and the discharge port 72 of the valve plate 70 are formed and selectively communicates with the intake port 71 or the discharge port 72 when the cylinder block 40 rotates about the rotation axial center 20C.

A piston 80 is disposed in each of the cylinders 42 in the cylinder block 40. The piston 80 is in a shape of a column having a circular cross section and is fitted in the cylinder 42 to be movable along an axial center. At a tip end portion of each piston 80 facing the swash plate 30, the piston shoe 81 is provided. The piston shoe 81 is formed by integrally molding a main spherical portion 81*a* formed in a shape of a sphere and a main pedestal portion 81*b* in a shape of a column. Each piston shoe 81 is supported, at its main spherical portion 81*a*, in a tip end portion of the piston 80 so as to be able to tilt and is in contact, at its main pedestal portion 81*b*, with the first sliding face 33 of the swash plate 30.

As illustrated in FIGS. 1 and 2, a portion of the main pedestal portion 81*b* in contact with the first sliding face 33 of the swash plate 30 is formed to be broad in each of the plurality of piston shoes 81 and the plurality of piston shoes 81 are linked with each other by a pressing plate 90 disposed between the broad portions and the main spherical portions 81*a*. The pressing plate 90 is a plate-shaped member having substantially the same outer diameter as the cylinder block 40 and has a pressing hole 91 at a central portion. In the pressing plate 90 and on a circumference a center of which is at the rotation axial center 20C of the rotating shaft 20, shoe mounting holes 92 are respectively formed in positions facing the cylinders 42 in the cylinder block 40. Each of the shoe mounting holes 92 is a through hole having such a dimension that the main spherical portion 81*a* of the piston shoe 81 can be inserted and the broad portion of the main pedestal portion 81*b* cannot be inserted. The pressing plate 90 is disposed between the cylinder block 40 and the swash plate 30 with the rotating shaft 20 inserted through the pressing hole 91 and the main spherical portions 81*a* of the piston shoes 81 inserted through the respective shoe mounting holes 92.

The pressing hole 91 formed in the pressing plate 90 has an inner peripheral face formed in a spherical shape and a retainer guide 100 is supported in the pressing hole 91. The retainer guide 100 is in a shape of a hemisphere having such an outer diameter as to be fitted in the pressing hole 91 in the pressing plate 90 and is disposed between the pressing plate 90 and the cylinder block 40 with the rotating shaft 20 inserted through a central portion of the retainer guide 100 and with the spherical portion in contact with the pressing hole 91 in the pressing plate 90. The retainer guide 100 and the outer peripheral face of the rotating shaft 20 are coupled by splines so that the retainer guide 100 can rotate with the rotating shaft 20 and move along the rotation axial center 20C of the rotating shaft 20. To the retainer guide 100, a pressing force of a pressing spring 101 mounted in the cylinder block 40 is constantly given through a transmission rod 102. The pressing force of the pressing spring 101 and given to the retainer guide 100 is given to the piston shoes 81 through the pressing plate 90 and acts to constantly keep the main pedestal portions 81*b* of the piston shoes 81 in contact with the first sliding face 33 of the swash plate 30.

In the hydraulic pump/motor formed as described above, if the rotating shaft 20 is rotated with respect to the casing 10, the cylinder block 40 rotates with the rotating shaft 20 and the pistons 80 in contact with the first sliding face 33 of the swash plate 30 with the piston shoes 81 interposed therebetween move in strokes with respect to the cylinders 42. To put it concretely, in a half area (on a low-pressure side below the division plane H in FIG. 1) which is separated off by the division plane H and in which the intake port 71 is provided, the pistons 80 move in strokes so as to protrude successively (leftward in FIG. 1) from the cylinders 42 and oil in the oil tank is taken into the cylinders 42 through the intake passage 12*a* and the intake port 71. On the other hand, in a half area (on a high-pressure side above the division plane H in FIG. 1) in which the discharge port 72 is provided, the pistons 80 move in strokes so as to recede into the cylinders 42 in the cylinder block 40 (move rightward in FIG. 1) and the oil in the cylinders 42 is discharged to the hydraulic operating machine (not illustrated) through the discharge port 72 in the valve plate 70 and the discharge passage 12*b*.

If the hydraulic pressure to be applied to the servo piston 60 is changed according to a load pressure of the hydraulic operating machine (not illustrated), for example, the servo piston 60 properly moves forward or backward with respect to the servo sleeve 61 provided in the case main body portion 11 to change the tilt angle of the swash plate 30 according to the hydraulic pressure. If the tilt angle of the swash plate 30 is changed, stroke movement amounts of the pistons 80 as a result of rotation of the cylinder block 40 change to change a flow rate of the oil to be discharged to the hydraulic operating machine (not illustrated) through the discharge passage 12*b*. To put it concretely, if the servo piston 60 moves in a protruding direction (rightward in FIG. 2), the first sliding face 33 of the swash plate 30 approaches a direction orthogonal to the rotation axial center 20C of the rotating shaft 20 and therefore the stroke movement amounts of the pistons 80 as a result of the rotation of the cylinder block 40 reduce and the flow rate of the oil discharged to the hydraulic operating machine (not illustrated) per unit rotation reduces as well. On the other hand, if the servo piston 60 moves in a receding direction (leftward in FIG. 2), the first sliding face 33 of the swash plate 30 moves away from the direction orthogonal to the rotation axial center 20C of the rotating shaft 20 and therefore the stroke movement amounts of the pistons 80 as a result of the rotation of the cylinder block 40 increase and the flow rate of the oil discharged to the hydraulic operating machine (not illustrated) per unit rotation increases as well.

Because pressing forces are applied on the swash plate 30 as reaction forces from the plurality of pistons 80 during the above-described operation, the sliding recessed portions 32 in the swash plate 30 and the sliding protruding portions 52 of the ball retainers 50 slide on each other while receiving the pressing forces. Therefore, problems such as seizing and galling may be caused between the sliding recessed portions 32 in the swash plate 30 and the sliding protruding portions 52 of the ball retainers 50 unless appropriate lubrication is carried out between them.

Therefore, in the above-described hydraulic pump/motor, the oil which leaks into the casing 10 and is stored is positively supplied between the sliding recessed portions 32 in the swash plate 30 and the sliding protruding portions 52 of the ball retainers 50 to carry out lubrication between them.

Figure 3:
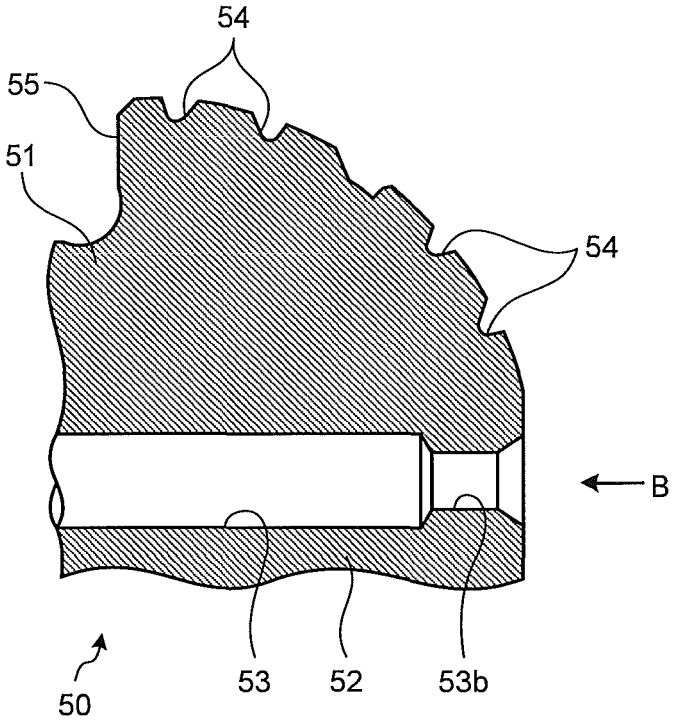
FIG. 3 is an enlarged sectional view of an essential portion of the support which is applied to the variable displacement hydraulic pump/motor illustrated in FIG. 1.
Figure 4:
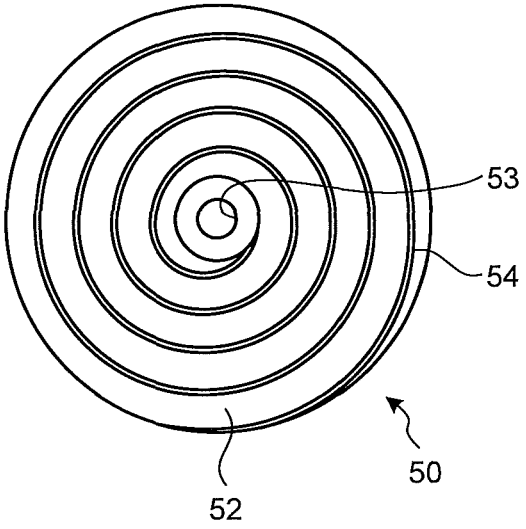
FIG. 4 is a view taken in a direction of arrow B in FIG. 3.
Figure 5:
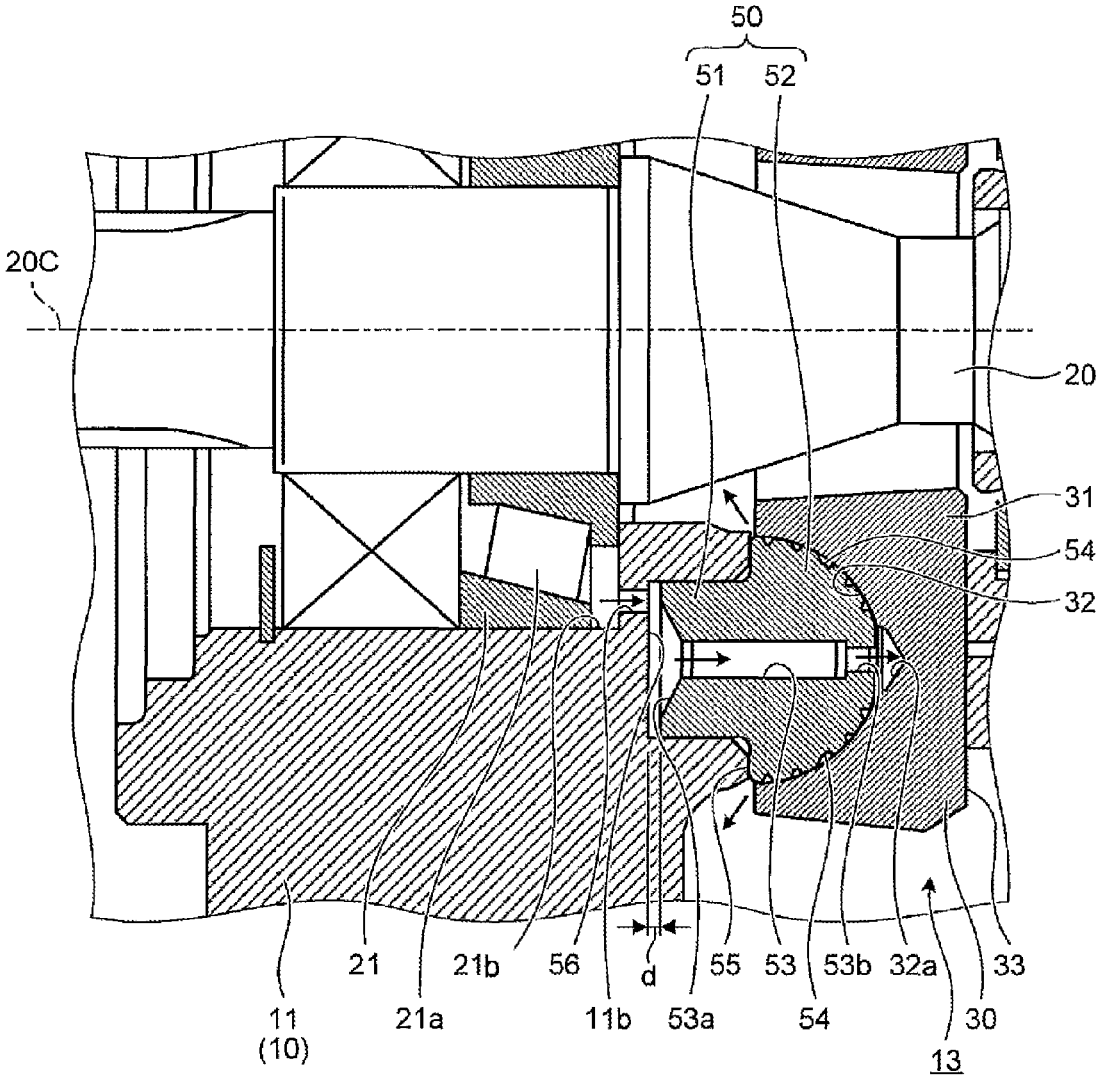
FIG. 5 is an enlarged sectional view of an essential portion of the variable displacement hydraulic pump/motor illustrated in FIG. 1.

To put it concretely, as illustrated in FIGS. 3 to 5, in each retainer of the pair of ball retainers 50, a through oil path 53 is formed to extend from a base end face of the shaft portion 51 to an outer peripheral face of the sliding protruding portion 52 and a lubrication groove 54 is formed in the outer peripheral face of the sliding protruding portion 52. An opening of the through oil path 53 on a side of the shaft portion 51 is not necessarily in the base end face but may be in any face, if the opening appears in an outer surface of the shaft portion 51 of the ball retainer 50 and the face is a face facing the mounting hole 11*b*.

As illustrated in FIG. 5, the through oil path 53 shown in the embodiment is a through hole formed in a portion which is on an axial center of the shaft portion 51, opens in the base end face of the shaft portion 51 through a tapered portion 53*a*, and opens in the outer peripheral face of the sliding protruding portion 52 through a small-diameter portion 53*b*. The ball retainer 50 is provided with a step portion 55 between the sliding protruding portion 52 and the shaft portion 51. The step portion 55 is for restricting an insertion amount of the shaft portion 51 inserted into the mounting hole 11*b* in the case main body portion 11 to maintain a clearance d between the base end face of the shaft portion 51 and an inner bottom face of the mounting hole 11*b*.

As illustrated in FIGS. 3 and 4, the lubrication groove 54 is the groove formed in the outer peripheral face of the sliding protruding portion 52. In the embodiment, the lubrication groove 54 is formed in the outer peripheral face of the sliding protruding portion 52 to extend from the opening of the through oil path 53 in such a manner as to draw a spiral about the axial center of the shaft portion 51 and to end at an edge portion between the outer peripheral face of the sliding protruding portion 52 and the step portion 55. The lubrication groove 54 is open in the edge portion between the outer peripheral face of the sliding protruding portion 52 and the step portion 55, even when the opening of the through oil path 53 is covered with the sliding recessed portion 32 in the swash plate 30, to thereby constantly connect the through oil path 53 to the operation space 13 which is outside a sliding contact area between the sliding protruding portion 52 and the sliding recessed portion 32. In the sliding recessed portion 32 in the swash plate 30, a storage recessed portion 32*a* is formed in a position facing the opening of the through oil path 53.

As illustrated in FIG. 5, in the casing 10, a communicating oil path 56 is formed in a portion between a housing space 21*b* for housing the main body-side bearing 21 and each of the respective mounting holes 11*b* in which the two ball retainers 50 are mounted. The communicating oil path 56 is for connecting the housing space 21*b* and an inside of the mounting hole 11*b* and is formed in the housing space 21*b* while displaced from the rotation axial center 20C toward an outer periphery side.

The through oil path 53 formed in the ball retainer 50 is formed so that the opening in the sliding protruding portion 52 is constantly covered with an inner wall face of the sliding recessed portion 32 and that the opening in the shaft portion 51 is covered with an inner wall face of the mounting hole 11*b* when the sliding protruding portion 52 is fitted in the sliding recessed portion 32 in the swash plate 30. However, the opening of the through oil path 53 in the sliding protruding portion 52 is communicating with the operation space 13 in the casing 10 through the spiral lubrication groove 54 formed in the outer peripheral face. Similarly, the opening of the through oil path 53 in the shaft portion 51 is communicating with the housing space 21*b* of the main body-side bearing 21 through the mounting hole 11*b* and the communicating oil path 56.

Therefore, if the rotating shaft 20 rotates, the main body-side bearing 21 rotates and therefore the oil stored in the housing space 21*b* flows due to a centrifugal force. Especially, in the embodiment, because the tapered rollers 21*a* are disposed in such orientations that their large-diameter portions are close to the swash plate 30, when the main body-side bearing 21 rotates, the oil stored in the housing space 21*b* moves into the mounting hole 11*b* through the communicating oil path 56 and then reaches the operation space 13 in the casing 10 from the mounting hole 11*b* through the through oil path 53 in the ball retainers 50 and the lubrication groove 54, as illustrated in FIG. 5. As a result, the oil passing through the lubrication groove 54 carries out the lubrication between the sliding protruding portion 52 of the ball retainer 50 and the sliding recessed portion 32 in the swash plate 30 to prevent the problems such as galling and seizing. Moreover, the larger the rotation number of the rotating shaft, the more an amount of oil passing through the lubrication groove 54 increases, and therefore it is possible to more reliably prevent the problems such as galling and seizing. Furthermore, pressure of the oil passing through the lubrication groove 54 is sufficiently lower than that of the oil discharged from the discharge port 72 and therefore the problem such as movement of the swash plate 30 toward the cylinder block 40 is not caused even in the ball retainer 50 supporting the low-pressure side.

Although the above-described embodiment is described as an example to be used as the hydraulic pump, the embodiment may be similarly used as the hydraulic motor.

Although the lubrication groove 54 is formed only on the sliding protruding portion 52 of the ball retainer 50, the lubrication groove 54 may be formed only in the inner peripheral face of the sliding recessed portion 32 in the swash plate 30 or may be formed in each of them. Because the spiral lubrication groove 54 is formed about the axial center of the shaft portion 51 in the above-described embodiment in forming the lubrication groove 54 in the outer peripheral face of the sliding protruding portion 52 of the ball retainer 50, it can be formed easily by using a rotating tool of a lathe and a manufacturing process is not complicated. However, the lubrication groove 54 does not necessarily have to be in the spiral shape and may be in other shapes such as a plurality of radiated shapes, if the lubrication groove 54 can connect the through oil path 53 to the operation space 13.

Figure 6:
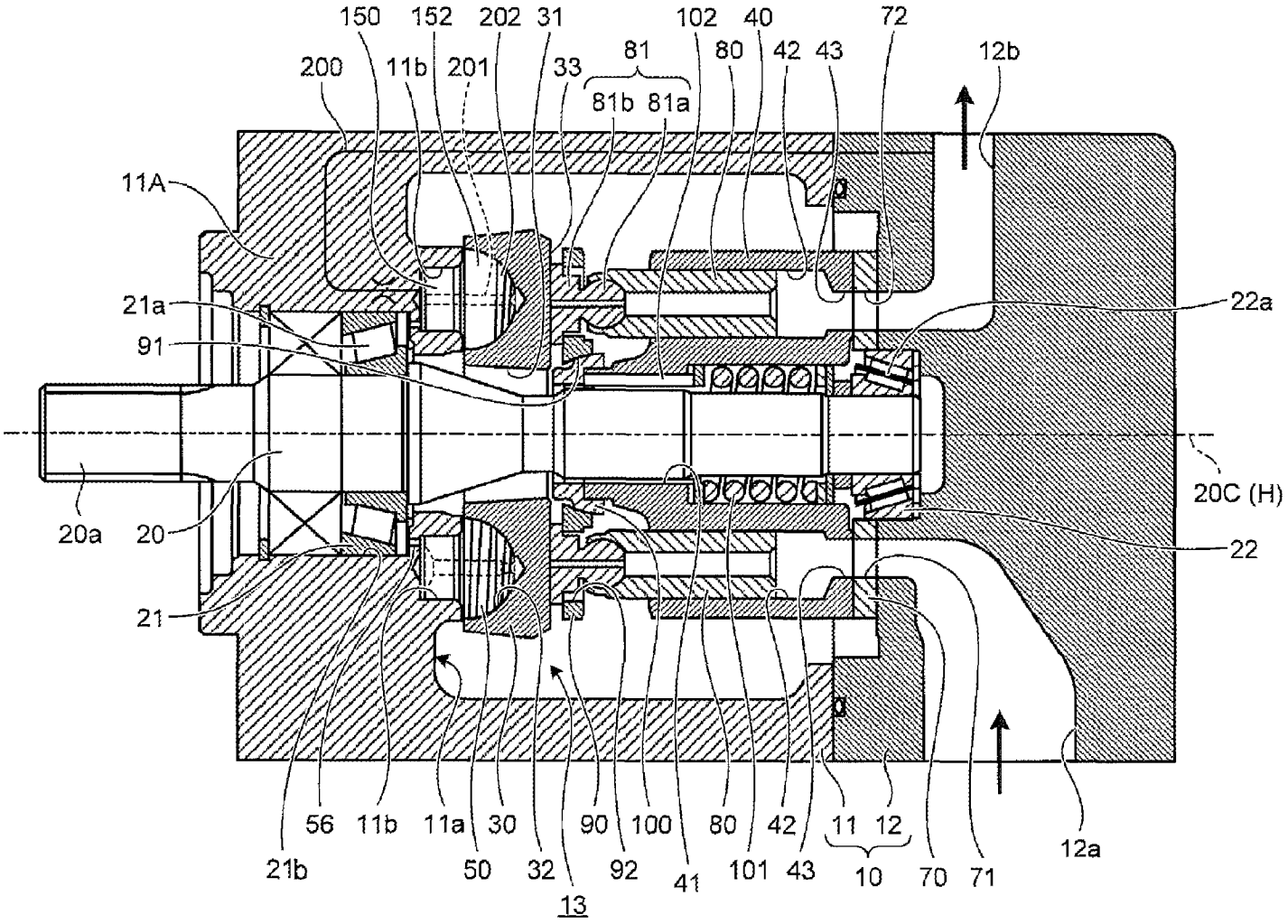
FIG. 6 is a sectional view illustrating a variation of the variable displacement hydraulic pump/motor according to the invention.

Moreover, although both of the ball retainer 50 for supporting the high-pressure side of the swash plate 30 and the ball retainer 50 for supporting the low-pressure side are lubricated with the same lubricating structure for carrying out the lubrication between the sliding protruding portions 52 of the ball retainers 50 and the sliding recessed portions 32 in the swash plate 30 in the above-described embodiment, the invention is not limited to this. For example, in a variation shown in FIG. 6, the above-described lubricating structure is applied only to the ball retainer 50 for supporting the low-pressure side which is a portion of the swash plate 30 below the division plane H and, for a ball retainer 150 for supporting the high-pressure side above the division plane H, the oil discharged from the discharge port 72 or the discharge passage 12*b* on the high-pressure side is supplied into the mounting hole 11*b* in the casing 10 through a supply oil path 200. Although a through oil path 201 similar to that in the embodiment is formed in the ball retainer 150 mounted into the mounting hole 11*b* in the casing 10, a lubrication groove 202 which ends in a sliding contact area between a sliding protruding portion 152 and the sliding recessed portion 32 in the swash plate 30 is formed on the sliding protruding portion 152. At the ball retainer 150 on the high-pressure side, the oil discharged from the discharge port 72 is pumped into the sliding contact area between the sliding protruding portion 152 and the sliding recessed portion 32 through the through oil path 201 and the lubrication groove 202 to carry out lubrication between them. In the variation shown in FIG. 6, the same structures as those in the embodiment are provided with the same reference signs and are not described in detail.

In this variation, for the ball retainer 50 supporting the low-pressure side, the oil in the housing space 21*b* of the main body-side bearing 21 moves into the mounting hole 11*b* through the communicating oil path 56 and then reaches the operation space 13 in the casing 10 from the mounting hole 11*b* through the through oil path 201 in the ball retainer and the lubrication groove 202. As a result, the oil passing through the lubrication groove 202 carries out the lubrication between the sliding protruding portion 152 of the ball retainer 50 and the sliding recessed portion 32 in the swash plate 30. Furthermore, pressure of the oil passing through the lubrication groove 202 is sufficiently lower than that of the oil discharged from the discharge port 72 and therefore the problem such as movement of the swash plate 30 toward the cylinder block 40 is not caused even in the ball retainer 50 supporting the low-pressure side. Although the high-pressure oil discharged from the discharge port 72 is pumped into the sliding contact area between the sliding protruding portion 152 and the sliding recessed portion 32 for the ball retainer 150 supporting the high-pressure side, the reaction force from the piston 80 is large and therefore the problem such as movement of the swash plate 30 toward the cylinder block 40 is not caused.

REFERENCE SIGNS LIST

10 CASING
11*b* MOUNTING HOLE
20 ROTATING SHAFT
20C ROTATION AXIAL CENTER
21 MAIN BODY-SIDE BEARING
21*b* HOUSING SPACE
21*a* TAPERED ROLLER
30 SWASH PLATE
32 SLIDING RECESSED PORTION
33 FIRST SLIDING FACE
40 CYLINDER BLOCK
50 BALL RETAINER (SUPPORT)
51 SHAFT PORTION
52 SLIDING PROTRUDING PORTION
53 THROUGH OIL PATH
54 LUBRICATION GROOVE
56 COMMUNICATING OIL PATH
80 PISTON

The invention claimed is:

1. A variable displacement hydraulic pump/motor comprising:

a rotating shaft rotatably supported in a casing;

a cylinder block rotating with the rotating shaft, the cylinder block including a plurality of cylinders on a circumference, a center of which is at an axial center of the rotating shaft;

a plurality of pistons respectively disposed to be movable in the cylinders in the cylinder block; and a swash plate disposed to be able to tilt in the casing with a pair of supports interposed between the swash plate and the casing at a position facing openings of the cylinders provided in the cylinder block, the swash plate slidably engaged, at a sliding face of the swash plate facing the cylinder block, with base end portions of the respective pistons, the pistons moving in strokes according to a tilt angle of the swash plate when the cylinder block rotates with respect to the swash plate, wherein the casing includes a tapered roller bearing rotatably supporting the rotating shaft near the pair of supports, each of the supports has a sliding protruding portion formed in a spherical shape at a tip end of a shaft portion of each of the supports, and a through oil path formed to extend from an outer surface of the shaft portion to an outer peripheral face of the sliding protruding portion, each of the supports being fitted, at the shaft portion of each of the supports, in a mounting hole in the casing and being fitted slidably, at the sliding protruding portion of the each of the supports, in a sliding recessed portion in the swash plate so as to cover an opening of the through oil path, a single, straight communicating oil path is formed between and directly connects a space in which a tapered roller of the tapered roller bearing is disposed in the casing to the mounting hole and communicates with the through oil path in the shaft portion, a lubrication groove constantly connecting the opening of the through oil path in the sliding protruding portion to an outside of a sliding contact area between the sliding protruding portion and the sliding recessed portion is formed between the sliding protruding portion of the support and the sliding recessed portion in the swash plate, and a housing space of the tapered roller bearing and a housing space of the swash plate communicate with each other through the communicating oil path, the mounting hole, the through oil path, and the lubrication groove, wherein the communicating oil path is provided in a portion of the casing while displaced from the axial center of the rotating shaft toward an outer periphery side, wherein the through oil path is provided while displaced from the axial center of the rotating shaft toward the outer periphery side with respect to the communicating oil path.

2. The variable displacement hydraulic pump/motor according to claim 1, wherein each of the lubrication grooves is formed in the sliding protruding portion in such a manner as to draw a spiral about the shaft portion of the support.

3. The variable displacement hydraulic pump/motor according to claim 1, wherein the tapered roller bearing interposed between the casing and the rotating shaft is arranged such that an end portion having a larger diameter of the tapered roller is close to the swash plate.

4. The variable displacement hydraulic pump/motor according to claim 1, wherein each of the supports has the sliding protruding portion at a tip end of the shaft portion formed in a circular columnar shape and the through oil path is formed on an axial center of the shaft portion.

5. The variable displacement hydraulic pump/motor according to claim 1, wherein when the tapered roller bearing rotates as a result of rotation of the rotating shaft, oil stored in the housing space of the tapered roller bearing flows due to a centrifugal force and passes through the lubrication groove.

* * * * *